US007371044B2

(12) United States Patent
Nereim

(10) Patent No.: US 7,371,044 B2
(45) Date of Patent: May 13, 2008

(54) SEAL PLATE FOR TURBINE ROTOR ASSEMBLY BETWEEN TURBINE BLADE AND TURBINE VANE

(75) Inventor: Brian D. Nereim, Winter Springs, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 246 days.

(21) Appl. No.: 11/244,741

(22) Filed: Oct. 6, 2005

(65) Prior Publication Data

US 2007/0080505 A1 Apr. 12, 2007

(51) Int. Cl.
*F01D 11/00* (2006.01)
*F04D 29/08* (2006.01)

(52) U.S. Cl. ..... 415/173.7; 416/220 R

(58) Field of Classification Search ..... 415/173.7, 415/174.4, 174.5; 416/219 R, 220 R
See application file for complete search history.

(56) References Cited

U.S. PATENT DOCUMENTS 3,266,770 A * 8/1966 Harlow ..... 416/92
3,733,146 A 5/1973 Smith et al.
3,814,539 A * 6/1974 Klompas ..... 416/95
4,451,203 A 5/1984 Langley
4,480,958 A * 11/1984 Schlechtweg ..... 416/220 R
4,505,642 A 3/1985 Hill
4,507,052 A 3/1985 Thompson
4,582,467 A 4/1986 Kisling
4,659,285 A 4/1987 Kalogeros et al.
4,659,289 A 4/1987 Kalogeros
4,669,959 A 6/1987 Kalogeros
4,685,863 A 8/1987 McLean
4,846,628 A 7/1989 Antonellis
4,872,810 A 10/1989 Brown et al.
5,118,120 A 6/1992 Drerup et al.
5,800,124 A * 9/1998 Zelesky ..... 416/95
6,315,298 B1 11/2001 Kildea et al.
6,416,282 B1 * 7/2002 Beeck et al. ..... 416/97 R
7,207,776 B2 * 4/2007 Townes et al. ..... 416/95

* cited by examiner

*Primary Examiner*—Edward K. Look
*Assistant Examiner*—Nathan Wiehe

(57) ABSTRACT

This invention relates to a seal plate system adapted to fit between axially adjacent turbine blades and turbine vanes to seal a rim cavity. The seal plate system may be formed from a seal plate supported by a plurality of extended disk lugs extending from a disk. The seal plate system may also include one or more extended disk lug receiving cavities adapted to receive protrusions extending from the disc. One or more ribs may extend from the seal plate for increasing the structural integrity of the seal plate.

16 Claims, 3 Drawing Sheets

SEAL PLATE FOR TURBINE ROTOR ASSEMBLY BETWEEN TURBINE BLADE AND TURBINE VANE

FIELD OF THE INVENTION

This invention is directed generally to turbine engines, and more particularly to seal plates usable to seal rim cavities proximate to turbine blades in turbine blade rotor assemblies of turbine engines.

BACKGROUND

In a conventional gas turbine engine, a rotor assembly is formed from a plurality of axially spaced rows of turbine blades separated by rows of stationary turbine vanes supported by framework proximate to the shell of the turbine engine. Adjacent rows of turbine blades may be separated by mini discs or other components to maintain the appropriate position of the turbine blades relative to each other. Due to the hot temperatures encountered by the turbine blades during normal turbine engine operation, conventional turbine blades typically include internal cooling systems and film cooling systems that receive cooling fluids from internal channels within the rotor assembly. Cooling fluids may be supplied to the turbine blades from rotor assemblies.

In conventional rotor assemblies, turbine vanes are sealed to the rotor assembly with a plurality of seal plates positioned axially between a row of turbine blades and a row of turbine vanes. The seal plates are supported in position with arms extending from the turbine blades. Because of the high temperature environment in which the seal plates are placed, seal plates are susceptible to buckling and other deformations. Thus, a need exists for an improved seal plate system.

SUMMARY OF THE INVENTION

This invention relates to a seal plate system adapted to fit between axially adjacent rows of turbine blades and turbine vanes and to seal a rim cavity on a turbine blade. The seal plate system may be formed from a seal plate adapted to restrict the flow of gases between a turbine blade and a turbine vane. The seal plate system may include a seal plate having a generally curved body that is curved circumferentially about a longitudinal axis of a turbine rotor assembly. The seal plate may include one or more extended disk lug receiving cavities for receiving extended disk lugs extending from a disc to which the seal plate may be attached. The extended disc lugs extend from the disc to couple a turbine blade to a disc and to support and radially position a seal plate relative to a disc. The extended disk lug receiving cavity may include an engaging surface adapted to engage an extended disc lug. The body may be configured to extend partially around a turbine rotor assembly.

The seal plate may also include at least one rib positioned in the at least one cavity. In one embodiment, the ribs may extend from proximate an outboard edge of the generally curved body to proximate an inboard edge of the generally curved body. The rib may increase the structural stability of the seal plate. In particular, the ribs may substantially eliminate buckling risks due to the rigid box structure formed by the ribs and body. In at least one embodiment, the body of the seal plate may include at least three ribs formed of a first rib positioned in a cavity generally centrally located in the seal plate, a second rib located at a first side of the body, and a third rib located at a second side of the body generally opposite to the first side. The seal plate may also include a first extended disk lug receiving cavity positioned between first and second ribs, and a second extended disk lug receiving cavity positioned between second and third ribs.

The seal plate may also include a connection device for attaching the generally curved body to the disc. The connection device may be formed from any device capable of attaching the seal plate to the rotor assembly or related component. In at least one embodiment, the connection device may be formed from at least one foot at an outboard edge of the body that is adapted to fit within a cavity in the disc and at least one foot at an inboard edge of the body that is adapted to be mechanically attached to the disc with a mechanical fastener. The inboard foot may include an aperture for receiving the mechanical fastener. An extension arm may extend from the generally curved body for limiting flow of gases between the turbine blade and an adjacent turbine blade. The extension arm may include a knife edge at an end of the extension arm for contacting the adjacent turbine vane.

An advantage of the invention is that the seal plate includes one or more ribs that increase the structural integrity of the seal plate and reduce the risk of, if not eliminate the risk of, buckling.

Another advantage of this invention is that seal plate provides efficient seal capabilities because of the increased structural integrity of the seal plate, which reduces the likelihood of seal plate warping and related problems.

Yet another advantage of this invention is that the disc includes an extended disc lug that is configured to contact and support the seal plate. The extended disc lug may be configured to control axial movement of the seal plate.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
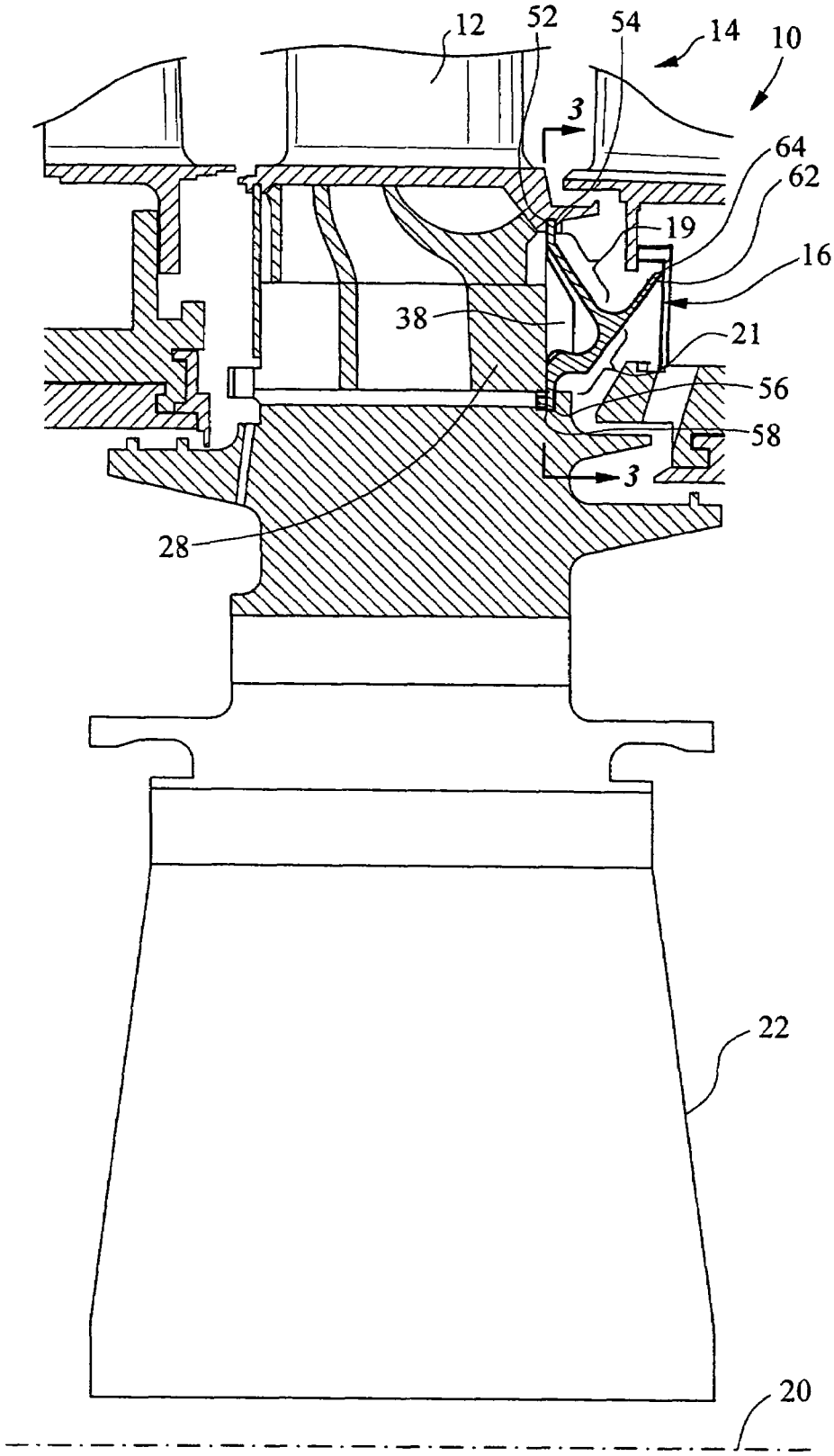
FIG. 1 is a partial cross-section of a turbine rotor assembly with a seal plate assembly coupled to a turbine blade.
Figure 2:
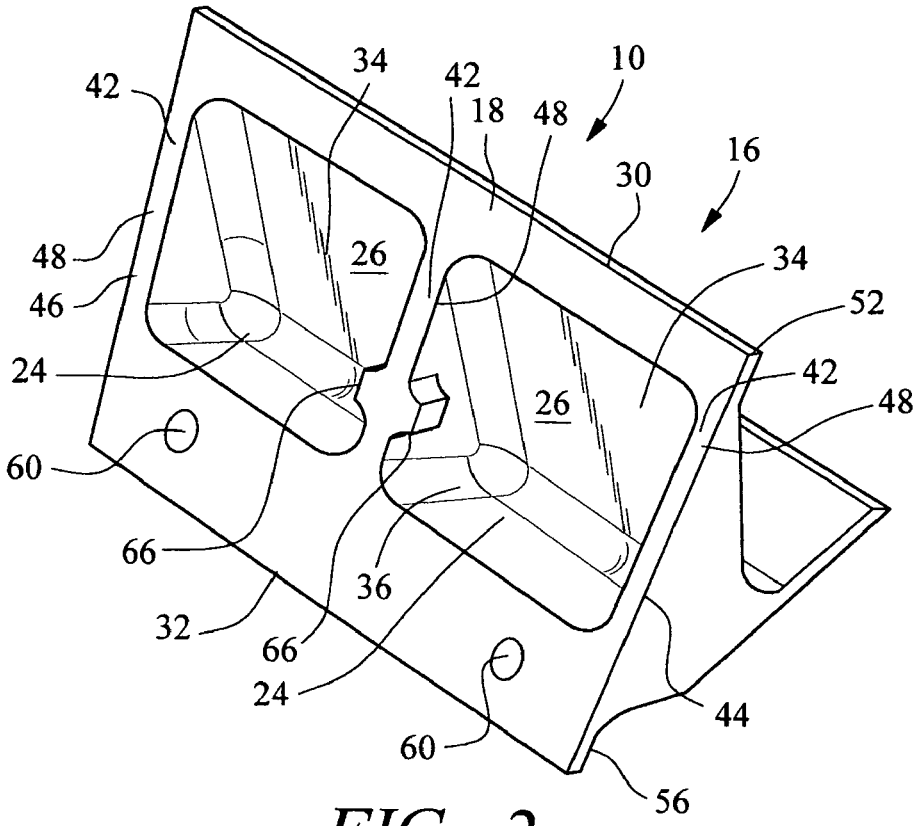
FIG. 2 is a perspective view of a seal plate having features according to the instant invention.

As shown in FIGS. 1-6, this invention is directed to a seal plate system 10 adapted to fit between axially adjacent rows of turbine blades 12 and turbine vanes 14 and to seal a rim cavity on a turbine blade 12. The seal plate system 10 may be formed from a seal plate 16 adapted to restrict the flow of gases between a turbine blade 12 and a turbine vane 14. The seal plate 16, as shown in FIG. 2, may be formed from a generally curved body 18 that is configured to curve circumferentially about a longitudinal axis 20 of a rotor assembly 22 to which the turbine blade 12 is attached. The seal plate 16 may form a segment of a circular ring and extend partially around the longitudinal axis 20. A plurality of seal plates 16 may be coupled together end to end to form a ring surrounding the longitudinal axis 20. The body 18 may be formed from a first section 19 positioned at an acute angle relative to a disc 28 and may include a second section 21 coupled to the first section 19. The second section 21 may extend from the first section 19 toward the disc 28 and may form an acute angle with the disc 28. The body 18 may be formed from alternative configurations as well. The body 18 may be formed from the following materials, such as, but not limited to, a nickel-based alloy, such as a cast INCO 718 or other appropriate materials.

The generally curved body 18 may include one or more one or more extended disk lug receiving cavities 34. The extended disk lug receiving cavities 34 may be configured to receive protrusions 38, such as extended disk lugs, extending from a disc 28 to support the seal plate 16 and to prevent the seal plate 16 from movement in the radial direction during operation of the turbine engine. The extended disk lug 38 may have a fir tree outline or other appropriate configuration. The extended disk lug receiving cavities 34 may form an engaging surface 26 that is adapted to engage an extended disk lug 38 extending from a disc 28 to support the seal plate 16. The engaging surface 26 may be configured to enable the seal plate 16 to remain in contact with the disc 28 when the seal plate 16 is attached to the disc 28. The extended disk lug receiving cavities 34 may extend from a position proximate to an outboard edge 30 of the body 18 to a position proximate to an inboard edge 32 of the body 18.

Figure 3:
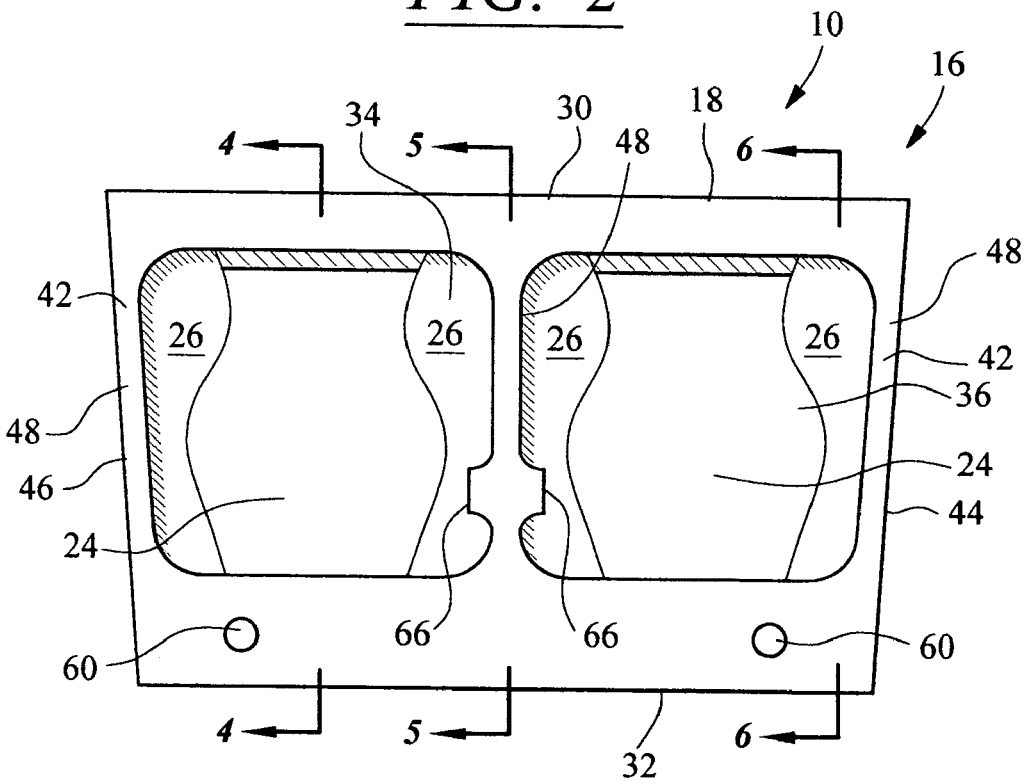
FIG. 3 is front plan view of the seal plate shown in FIG. 2 with partial cross-sectional view of extended disk lugs positioned within the extended disc lug receiving cavities in the seal plate a viewed from section line 3-3 in FIG. 1.
Figure 4:
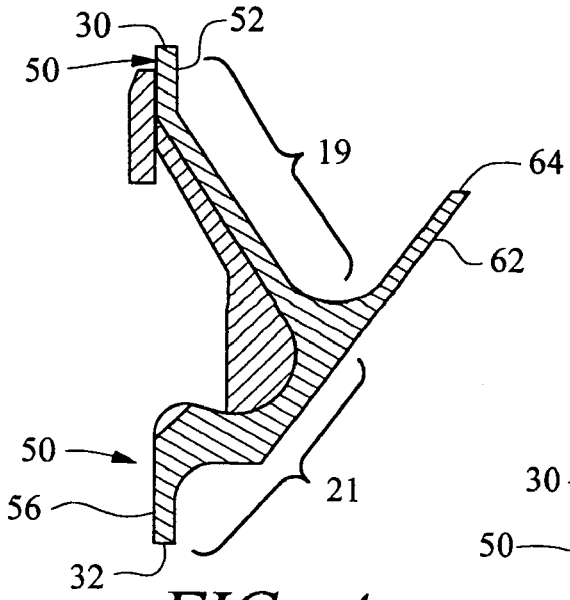
FIG. 4 is a cross-sectional view of the seal plate taken at section line 4-4 in FIG. 3.
Figure 5:
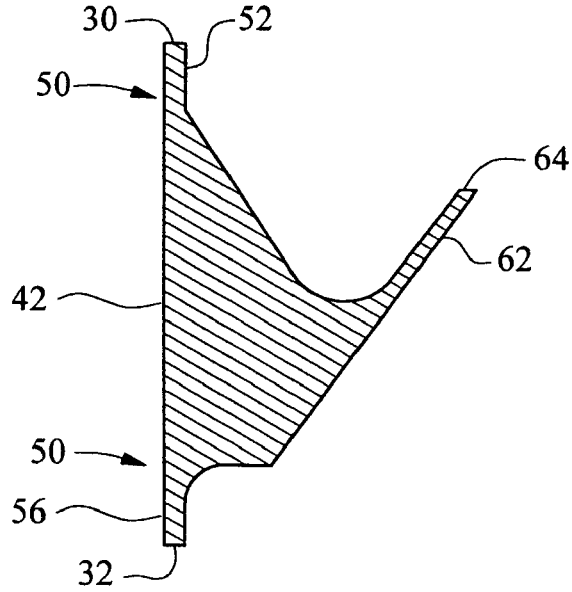
FIG. 5 is a cross-sectional view of the seal plate taken at section line 5-5 in FIG. 3.
Figure 6:
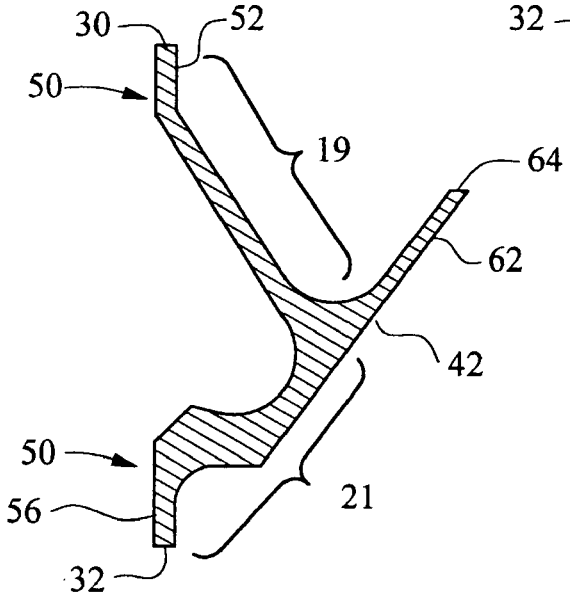
FIG. 6 is a cross-sectional view of the seal plate taken at section line 6-6 in FIG. 3.

The body 18 may include one or more ribs 48 for increasing structural integrity of the body 18, as shown in FIGS. 2, 3, and 5. In at least one embodiment, the ribs 48 may extend from a position proximate to the outboard edge 30 to a position proximate to the inboard edge 32. The rib 48 may be positioned generally centrally within the body 18 and within the extended disk lug receiving cavity 34. A rib 48 may also be positioned at the first side 44, and a rib 48 may be positioned at the second side 46. The ribs 48 may define the extended disk lug receiving cavities 34. The ribs 48 may extend from the body 18 and form a surface 42 for contacting the disc 28. One or more centering bumpers 66 may extend laterally from the ribs 48 into the extended disk lug receiving cavities 34. In at least one embodiment, the centering bumper 66 may extend generally orthogonal from the rib 48. A first centering bumper 66 may extend from a first side of the central rib 48 and a second centering bumper 66 may extend from a second side of the rib 48 generally opposite to the first side. The centering bumpers 66 may control the position of the seal plate 16 in the circumferential direction.

The seal plate 16 may include a connection device 50 for attaching the seal plate 16 to the disc 28. The connection device 50 may be any device configured to attach the seal plate 16 to the disc 28. In at least one embodiment, the connection device 50 may include a foot 52 positioned at the outboard edge 30 of the body 18. The foot 52 may extend all of or a portion of the width of the body 18 from the first side 44 to the second side 46. The foot 52 may have a thickness enabling it to be received within a cavity 54 in the disc 28. The foot 52 may or may not form an interference fit when inserted into the cavity 54. The connection device 50 may also include a foot 56 positioned at an inboard edge 32 of the body 18. The foot 56 may likewise extend across a portion of or all of the width of the body from the first side 44 to the second side 46. The foot 56 may be attached to the disc 28 of the turbine blade 12 using a mechanical fastener 58, which may be, but is not limited to, a retaining ring, a locking screw, a bolt, or other appropriate devices. In at least one embodiment, the foot 56 may include one or more apertures 60 for receiving a bolt 58 for attaching the body 18 to the disc 28.

The seal plate 16 may also include one or more extension arms 62. The extension arms 62 may be configured to limit the flow of gases between the turbine blade 12 and turbine vane 14. In particular, the extension arms 62 may be configured to prevent the combustion gases from passing into the rotor assembly 22. The extension arm 62 may extend across all of or a portion of the width from the first side 44 to the second side 46 of the body 18. In at least one embodiment, the extension arm 62 may include a knife edge 64 designed for contact with a turbine vane 16.

The seal plate 16 may be installed in a rotor assembly 22 such that the engaging surface 26 is in contact with a disc 28. The seal plate 16 may be installed on upstream or downstream sides of the turbine blade 12. The outboard foot 52 may be inserted within the cavity 54, and the inboard foot 56 may be attached to the disc 28 with a mechanical fastener 58. In this position, the extension arm 62 extends toward and within close proximity of an adjacent turbine vane 14 to limit hot combustion gases from flowing into the rotor assembly 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A seal plate, comprising:

a generally curved body that is curved circumferentially about a longitudinal axis of a turbine rotor assembly and adapted for connection to a disc, said body being characterized by a blade-facing side and an opposite vane-facing side;

at least one extended disk lug receiving cavity forming an engaging surface adapted to engage an extended disk lug extending from the disc, said cavity extending generally away from said blade-facing side and toward said vane-facing side;

at least one rib positioned in the at least one extended disk lug receiving cavity and extending from proximate an outboard edge of the generally curved body to proximate an inboard edge of the generally curved body; and an extension arm extending from the generally curved body for limiting flow of gases between a turbine blade and an adjacent turbine vane.

2. The seal plate of claim 1, wherein the at least one rib comprises at least three ribs, a first rib positioned in at least one extended disk lug receiving cavity generally centrally located in the seal plate, a second rib located at a first side of the body, and a third rib located at a second side of the body generally opposite to the first side.

3. The seal plate of claim 2, wherein the first, second, and third ribs are generally parallel to each other.

4. The seal plate of claim 2, further comprising at least one centering bumper extending generally laterally from the first rib.

5. The seal plate of claim 4, wherein the at least one centering bumper comprises a first centering bumper extending generally orthogonally from a first side of the first rib and a second centering bumper extending generally orthogonally from a second side of the first rib that is opposite to the first side.

6. The seal plate of claim 1, wherein the seal plate further comprises at least one foot at an outboard edge of the body that is adapted to fit within a cavity in the disc and at least one foot at an inboard edge of the body that is adapted to be mechanically attached to the disc.

7. The seal plate of claim 6, wherein the inboard edge of the body that is adapted to be mechanically attached to the disc includes at least one aperture for receiving a mechanical fastener to couple the seal plate to the disc.

8. The seal plate of claim 1, wherein the generally curved body is configured to extend partially around a turbine rotor assembly.

9. The seal plate of claim 1, wherein the extension arm includes a knife edge at an end of the extension arm.

10. A seal plate, comprising:

a generally curved body that is curved circumferentially about a longitudinal axis of a turbine rotor assembly, said body being characterized by a blade-facing side and an opposite vane-facing side;

at least two extended disk lug receiving cavities forming an engaging surface adapted to engage extended disk lugs extending from a disc, said cavities extending generally away from said blade-facing side and toward said vane-facing side;

a first rib positioned in one of the at least two extended disk lug receiving cavities generally centrally located in the seal plate and extending from proximate an outboard edge of the generally curved body to proximate an inboard edge of the generally curved body;

a second rib located at a first side of the body;

a third rib located at a second side of the body generally opposite to the first side; and an extension arm extending from the generally curved body for limiting flow of gases between a turbine blade and an adjacent turbine vane.

11. The seal plate of claim 10, wherein the first, second, and third ribs are generally parallel to each other.

12. The seal plate of claim 10, further comprising at least one centering bumper extending generally laterally from the first rib.

13. The seal plate of claim 12, wherein the at least one centering bumper comprises a first centering bumper extending generally orthogonally from a first side of the first rib and a second centering bumper extending generally orthogonally from a second side of the first rib that is opposite to the first side.

14. The seal plate of claim 10, wherein the seal plate further comprises at least one foot at an outboard edge of the body that is adapted to fit within a turbine blade protrusion receiving cavity in the disc and at least one foot at an inboard edge of the body that is adapted to be mechanically attached to the disc with a mechanical fastener.

15. The seal plate of claim 10, wherein the extension arm includes a knife edge at an end of the extension arm.

16. A seal plate, comprising:

a generally curved body that is curved circumferentially about a longitudinal axis of a turbine rotor assembly and adapted for connection to a disc;

at least one extended disk lug receiving cavity forming an engaging surface adapted to engage an extended disk lug extending from the disc;

at least one rib positioned in the at least one extended disk lug receiving cavity and extending from proximate an outboard edge of the generally curved body to proximate an inboard edge of the generally curved body, said at least one rib comprising at least three ribs, a first rib positioned in at least one extended disk lug receiving cavity generally centrally located in the seal plate, a second rib located at a first side of the body, and a third rib located at a second side of the body generally opposite to the first side;

at least one centering bumper extending generally laterally from the first rib; and an extension arm extending from the generally curved body for limiting flow of gases between a turbine blade and an adjacent turbine vane.

* * * * *